United States Patent [19]

Hopkinson

[11] Patent Number: 4,938,173

[45] Date of Patent: Jul. 3, 1990

[54] FLUID SYSTEM

[75] Inventor: Kenneth E. Hopkinson, South Yorkshire, United Kingdom

[73] Assignee: Cubit Limited, Birmingham, United Kingdom

[21] Appl. No.: 235,894

[22] PCT Filed: Dec. 3, 1987

[86] PCT No.: PCT/GB87/00870

§ 371 Date: Oct. 11, 1988

§ 102(e) Date: Oct. 11, 1988

[87] PCT Pub. No.: WO88/04390

PCT Pub. Date: Jun. 16, 1988

[30] Foreign Application Priority Data

Dec. 11, 1986 [GB] United Kingdom ..... 8629644

[51] Int. Cl.[5] ..... F22B 27/00

[52] U.S. Cl. ..... 122/40; 137/118; 137/565.1; 122/448 B; 122/451.1; 122/451.2

[58] Field of Search ..... 122/40, 448 B, 451.1, 122/451.2; 137/118, 565.1

[56] References Cited

U.S. PATENT DOCUMENTS

| | | | |
|---|---|---|---|
| 2,703,073 | 3/1955 | Klein et al. . | |
| 2,780,206 | 2/1957 | LaRocque et al. | 122/448 B |
| 4,014,577 | 3/1977 | Clancy et al. | 137/118 X |
| 4,057,073 | 11/1977 | Adams | 137/118 |
| 4,061,271 | 12/1977 | Kimbrough . | |
| 4,182,354 | 1/1980 | Bergstedt . | |
| 4,421,068 | 12/1983 | Aral | 122/448 B |
| 4,576,124 | 3/1986 | Martens et al. | 122/448 B X |

FOREIGN PATENT DOCUMENTS

| | | |
|---|---|---|
| 652030 | 10/1937 | Fed. Rep. of Germany . |
| 793866 | 12/1935 | France . |

*Primary Examiner*—Edward G. Favors

*Attorney, Agent, or Firm*—Klarquist, Sparkman, Campbell, Leigh & Whinston

[57] ABSTRACT

A fluid system for example for steam raising comprising a flow control device (20), means (28) to supply a head of fluid to the flow control device (20), and at least one fluid using means such as a flash boiler (12–14), the flow control device (20) comprising a chamber (48), an inlet (49) to the chamber from the fluid supply means (28), and an outlet (21–23) from the chamber (48), a valve means (40) associated with the outlet (21–23) operable to direct fluid from the outlet (21–23) either to the fluid using means (12–14) or to a relief means (43–45).

12 Claims, 2 Drawing Sheets

FLUID SYSTEM

DESCRIPTION OF INVENTION

Figure 1:
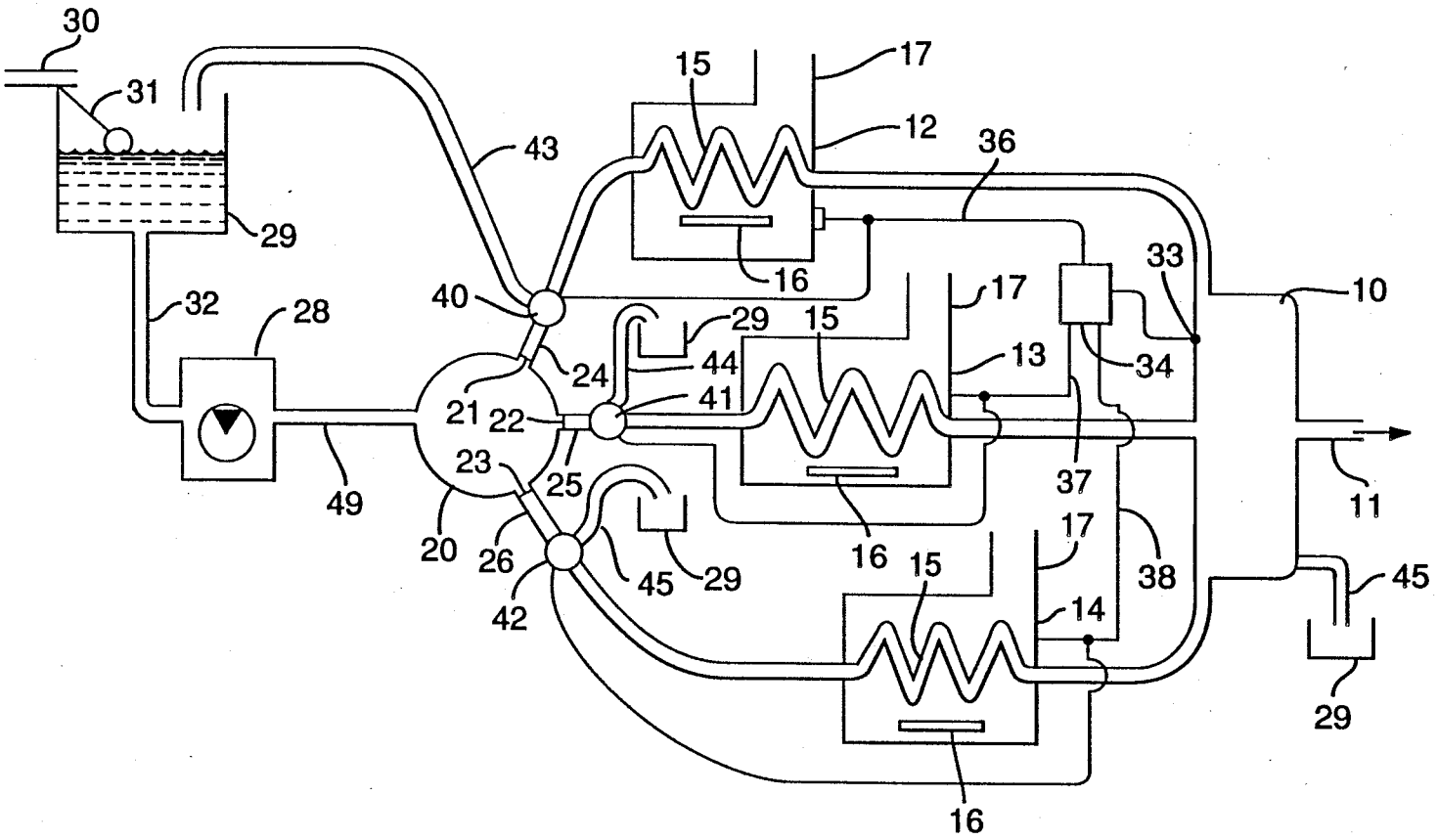

This invention relates to a fluid system and more particularly, but not exclusively to a fluid system for steam raising. In a steam raising system conventionally there is a flash boiler to which water is fed by a pump. The flash boiler provides steam under pressure to a steam accumulator from where steam may be drawn off for use. The capacity of the pump needs to be matched to the capacity of the flash boiler for efficient production of steam.

In such a system where a single flash boiler is provided, the pressure of steam achieved in the steam accumulator is sensed, and when an upper steam pressure is sensed, the flash boiler is shut down and the pump deactivated. When the pressure of steam in the steam accumulator falls to a second threshold pressure, the flash boiler and pump are reactivated. Necessarily the warm up time is long where there are frequent such shut downs. Furthermore, the life of the pump can be shortened by frequently switching the pump on and off.

If it is desired to increase the capacity of the system, for example to double the capacity of the system, it is necessary to provide an additional pump and flash boiler which can provide steam to the steam accumulator, or an enlarged steam accumulator if required. In such a multiple flash boiler arrangement, when a first upper threshold pressure is sensed in the steam accumulator, only one of the boilers and associated pumps are shut down. If the pressure in the system continues to rise to a second upper threshold pressure, the second flash boiler and pump are deactivated, and so on in systems having more than two boilers and pumps.

Switching on or off of the boilers and associated pumps may be achieved automatically via a control means, or manually in response to warning signals provided to an operator.

An object of the present invention is to provide a new or improved fluid system.

According to one aspect of the invention we provide a fluid system comprising a flow control device, means to supply a head of fluid to the flow control device, and at least one fluid using means, the flow control device comprising a chamber, an inlet to the chamber from the fluid supply means, and an outlet from the chamber, a valve means associated with the outlet operable to direct fluid from the outlet either to the fluid using means or to a relief means.

Thus in a system embodying the invention where a head of fluid is provided by a pump there is no need to match the capacity of the pump to the capacity of the system but provided that the pump can deliver more fluid to the fluid control device than required by the or each of the fluid using means, any capacity of pump may be used. However, the outlet needs to be sized to ensure that the amount of fluid fed to the fluid using means, when the valve means permits this, is that required by the fluid using means.

Preferably the outlet from the chamber is sized so that the pressure in the chamber is always greater than the pressure downstream of the flow control device so that changes in pressure in the system, e.g. in the fluid using means do not have any significant effect on the pressure in the chamber and hence on the performance of the pump. Preferably the pressure in the chamber is arranged to be at least twice the maximum pressure downstream of the flow control device e.g. in the fluid using means, but more preferably the pressure in the chamber is even greater than this.

Operation of the valve means may be controlled by a control means responsive to a sensor means which senses a parameter of the system so that when a threshold value of the parameter is sensed, the fluid using means is deactivated so that there is no further fluid required, and the valve means is operated to cause fluid from the outlet of the chamber to be directed to the relief means so there is no need to deactivate the pump.

In a greater capacity system, the chamber may have a plurality of outlets each having an associated valve means operable to direct fluid to an associated fluid using means or to a relief means.

Thus there is no need to have a pump for each fluid using means although all of the outlets of the chamber would need to be sized to ensure that each of the fluid using means receive the required amount of fluid from the chamber of the flow control device. Preferably, all of the outlets from the chamber of the flow control device are of the same size where the fluid using means are all similarly rated.

Each of the valve means may be controlled by a control means responsive to sensor means sensing a parameter of the system to which all of the fluid using means may contribute. The relief means may comprise a conduit which returns fluid from the or each valve means to a reservoir from which fluid may be drawn to supply the head of fluid. The reservoir may comprise a vessel having an inlet from a fluid source, the amount of fluid permitted to enter the vessel via the inlet being controlled by a valve, such as a float control valve, sensitive to the level of fluid within the vessel.

The invention is particularly applicable to a fluid system comprising a steam raising system wherein the or each fluid using means may comprise a flash boiler, and the parameter sensed is the pressure of steam produced by the, or all of the flash boilers.

The system may incorporate a steam accumulator to which steam is fed from the or each flash boiler, and the pressure of steam in the accumulator may be sensed by the sensor means.

Where a single flash boiler only is provided, the control means may operate the valve means to deactivate the flash boiler when the pressure of steam in the system, preferably in the steam accumulator where provided, reaches an upper threshold pressure, and operate the valve means to direct water to the relief means, and the control means may reactivate the flash boiler again and operate the valve means to direct fluid to the flash boiler when a lower threshold steam pressure is sensed.

Where a plurality of flash boilers are provided each of the flash boilers may be arranged to be deactivated by the control means in turn when an associated threshold pressure is sensed, and the control means may be arranged to de-activate and reactivate the flash boilers and operate the respective valve means in a predetermined sequence to ensure that each of the flash boilers are used generally equally.

According to a further aspect of the invention we provide a method of operating a fluid system in accordance with the first aspect of the invention, the method comprising the steps of sensing a parameter of the system, signalling a control means when an upper threshold value of the parameter is sensed, the control means in response, de-activating the fluid using means and signalling the valve means to direct fluid from the outlet of the flow control device to the relief means, and signalling the control means when a lower threshold valve of the parameter is sensed, the control means in response re-activating the fluid using means and signalling the valve means to direct fluid to the fluid using means.

Figure 2:
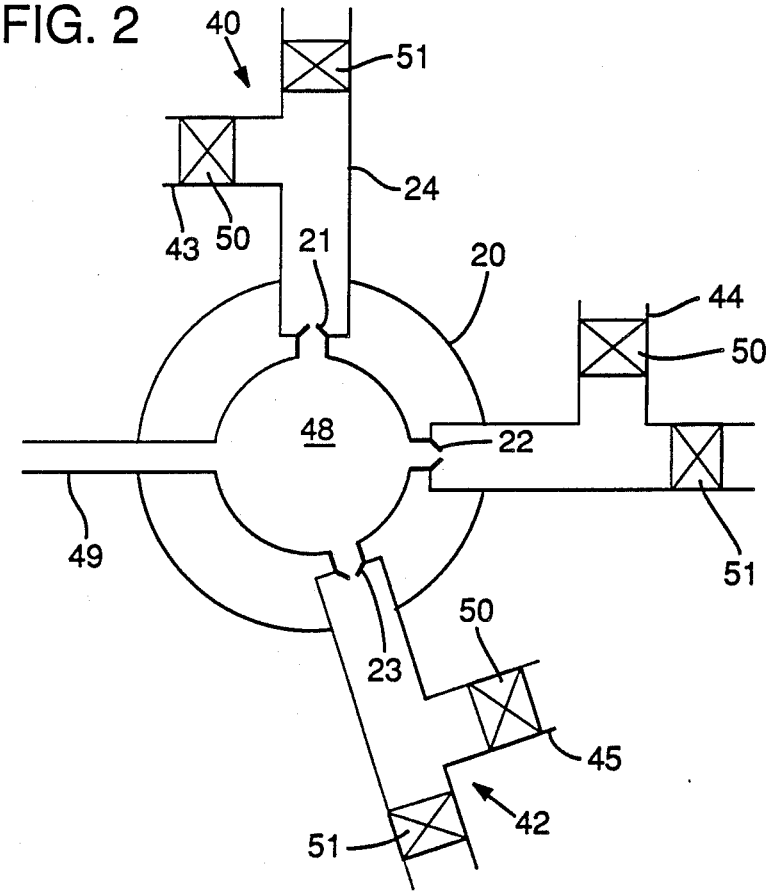

The invention will now be described with the aid of the accompanying drawings in which:

FIG. 1 is a diagrammatic illustration of a fluid system in accordance with the invention, and, FIG. 2 is an enlarged illustrative view of part of the system of FIG. 1.

Referring to the drawings, a steam raising system comprises a steam accumulator 10 from which steam may be drawn off via a supply line 11 when required for use.

Steam is supplied to the steam accumulator 10 from, in this example three, flash boilers 12,13 and 14 of substantially identical rating.

Each of the flash boilers 12 to 14 incorporate a heating coil 15 through which water passes as it is heated by a burner 16, in the present example an oil or gas burner, the products of combustion passing from the flash boilers 12,13,14, by respective flues 17 which conveniently are connected together and to a common flue outlet.

Water is supplied to each of the flash boilers 12,13,14, from a flow control device 20 which will be described in detail hereinafter, the device 20 having outlets 21,22,23, each to a respective supply conduit 24,25 and 26 through which water may pass from the flow control device 20 to the respective flash boiler 12,13,14.

Water is fed to the flow control device 20 from a positive displacement high capacity pump 28 which is connected to a water source 29 comprising a vessel having an inlet 30. The level of water within the vessel 29 is controlled by a float control valve 31, and a conduit 32 connects the vessel 29 to the pump 28.

The pressure of steam within the steam accumulator 10 is sensed by a sensing means 33 which provides signals to a control means 34 which is arranged to operate as follows.

As the steam pressure in the steam accumulator 10 rises to a first upper threshold pressure, the control means 34 is arranged to de-activate one of the flash boilers 12 to 14, for example boiler 12, by signalling the boiler along a line 36. If the steam pressure in the accumulator 10 continues to rise, another boiler, for example boiler 13 is de-activated by a signal passed from the control means 34 along a line 37.

If the steam pressure in the accumulator 10 rises further, for example if little or no steam is being drawn off for use, the control means 34 de-activates the last boiler 14 by sending a signal along a line 38.

Preferably the sequence in which the boilers 12 to 14 are de-activated is changed periodically by a sequencer of the control means 34 to ensure that each of the boilers 12 to 14 are operated generally equally.

As steam is drawn off for use along the supply line 11, the pressure within the steam accumulator 10 may fall. As the steam pressure falls below a first threshold pressure, one of the boilers 12 to 14, preferably boiler 12 if de-activated first, is re-activated. As the pressure continues to fall, a further boiler, for example boiler 13, is re-activated, and if the pressure still continues to fall, the final boiler 14 will be re-activated.

Preferably of course, the boilers 12–14 at least when all activated, are able to produce more steam than is required in line 11 for use.

In practice, all of the boilers 12–14 may not be de-activated before one or all of the boilers 12–14 are re-activated again. This will depend on the rate of use of the steam. The boilers 12 to 14 may be activated or de-activated as necessary by the control means 34 to ensure that the pressure in the steam accumulator 10 remains within a predetermined pressure range so there is always an adequate supply of steam in the steam accumulator 10.

It can be seen that each outlet 21,22,23, has an associated valve means 40,41, and 42 in the respective supply conduit 24,25,26, which in this example are solenoid operated valves, also controlled by the control means 34. When the control means 34 signals the boiler 12 to be de-activated, a signal is also sent to valve means 40 so that water is no longer supplied along supply conduit 24 to the flash boiler 12, but is diverted to a relief conduit 43. When a signal is sent from the control means 34 along line 36 to the boiler 12 to cause the boiler 12 to be re-activated, a signal is also sent to the valve means 40 to cause the water to again be directed from the supply conduit 24 to the flash boiler 12.

Similarly, the valves 41 and 42 operate either to direct water to the respective flash boiler 13,14, or to an associated relief conduit 44,45.

Each of the relief conduits 43,44, and 45 are arranged to return water to the vessel 29 so that the water may be recycled, although the excess water may be disposed of from the conduits 43–45 otherwise as required.

Furthermore, the steam accumulator 10 has an outlet 45 arranged to return condensate from the steam accumulator 10 to the vessel 29.

Referring now to FIG. 2, the construction of the flow control device 20 can be seen.

The device 20 includes a central chamber 48 to which there is an inlet 49 connected to pump 28.

The outlets 21,22 and 23 each comprise an injector nozzle having an orifice of a predetermined size. The pump 28 as hereinbefore mentioned is of large capacity and is arranged to ensure that the water pressure in chamber 48 is always at least twice as great as the maximum pressure attainable by the steam in the steam accumulator 10 by operation of all of the flash boilers 12,13,14. The orifices of each of the outlets 21,22,23, are very small and are arranged so water is injected from the chamber 48 into the supply conduits 24,25, and 26 at a predetermined rate so that the amount of water supplied is that required by the respective flash boiler 12,13,14, to operate efficiently i.e. the nozzle outlet size is matched to the capacity of the respective boiler 12,13,14. Of course, the sizes of all three outlets 21,22, and 23 need to be chosen together to ensure that the correct flow of water to each of the respective flash boilers 12 to 14 is attained because if the size of any one outlet orifice was changed, the supply through the remaining orifices would be effected.

In the present case, the boilers 12,13 and 14 are each of the same rating and hence the nozzle outlets 21,22, and 23 are essentially of the same size so that an equal quantity of water is fed to each of the supply conduits 24 to 26.

The construction of the valve means 40 is also illustrated in FIG. 2.

Preferably the valve means 40 comprises a valve 50 in the return conduit 43, and a valve 51 in the supply conduit 24 between the outlet 21 and the flash boiler 12, the two valves 50 and 51 being arranged to operate in tandem so that when valve 50 is open, valve 51 is closed, and vice versa, the valves being solenoid operated in response to a signal from the control means 34.

The constructions of the valve means 41 and 42 are similar and the same parts are labelled with the same reference numerals.

However any other type of valve means which operates to divert water either to the respective flash boiler or to a relief means may be provided.

It will be appreciated that the invention provides significant advantages over conventional systems in which each flash boiler 12 to 14 would require its own pump. In the present example, provided that the capacity of the pump 28 exceeds the total water requirement of the steam raising system, any desired capacity of pump can be used, it only being necessary to select the orifice sizes of the outlets 21–23 to match both the capacity of the pump and the requirement of the associated flash boilers.

If it is desired to increase the capacity of the system still further, it is simply necessary to provide a further outlet from the flow control device 20 which would have a valve means to direct fluid either to the further flash boiler or to a relief means. However, simply to increase the capacity of the system in this way the sizes of the nozzles of outlets 21 to 23, would need to be changed in order to ensure that the same quantity of fluid is provided to each of the flash boilers 12 to 14 as when only the three outlets shown, are provided.

In a preferred arrangement, a flow control device 20 would be provided having a predetermined number of outlets, for example ten outlets. Each outlet would already be connected to a supply conduit such as conduits 24 to 26, but each of the outlets not in use i.e. not connected to a flash boiler, would be connected to a relief conduit returning the water from the outlet to the vessel 29. As and when required, an additional valve means can be installed with one of the previously unused outlets, so that water can be directed to a further flash boiler when required, which could be arranged to contribute to the capacity of the steam raising system. Thus this would not affect the outlets already in use. Of course, the additional valve means would need to be connected to the control means 34, which may need to be reprogrammed. Thus instead of the water from the previously unused outlet passing to the relief conduit, the water could be fed to the further flash boiler or to the relief condition, under the control of the control means 34. In this way, the capacity of the system may be increased (or decreased) without having to change the size of any nozzle in any of the outlets of the flow control device 20.

Although the invention has been described in relation to a steam raising system having three flash boilers, it will be appreciated that the system may be used with a single or two flash boilers only, or any number of flash boilers as required, the capacity of the system only being limited by the number of outlets which the flow control device 20 may be provided with and the capacity of the pump 28.

Thus the invention provides a modular steam raising system the capacity of which may be simply increased or decreased as required within a large range, without having to change the capacity of the pump.

Various modifications may be made without departing from the scope of the invention. For example, the flash boilers 12 to 14 need not be oil or gas fired as described, but could be electrically fired as desired. Each of the flash boilers may provide steam to its own steam accumulator if desired which would have its own associated sensor means and control means to control the flash boiler.

Although specifically described in relation to a steam raising system the invention may be applied to any fluid system having one or more fluid using means to which fluid must be fed at a predetermined rate to match the capacity or rating of the fluid using means. For example, the invention may be applied to a conventional boiler arrangement or even a hydraulic circuit. Thus the valve means associated with each outlet of the flow control device may be operable in response to any sensed parameter of the system downstream of the flow control device, such as water temperature in a conventional boiler arrangement, or hydraulic pressure, in a hydraulic circuit.

The features disclosed in the foregoing description, in the following claims, or the accompanying drawings, expressed in their specific forms or in terms of a means for performing the function, or a method or process for attaining the disclosed result, or a class or group of substances or compositions, as appropriate, may, separately or in any combination of such features, be utilised for realising the invention in diverse forms thereof.

I claim:

1. A fluid system comprising a plurality of water using boilers, a single pump means, and a flow control device, the flow control device comprising a chamber, an inlet to the chamber, means connecting the inlet to the single pump means which supplies a head of water to the flow control device, and the flow control device further comprising a plurality of outlets, one for each of the water using boilers, a valve means associated with each outlet, means connecting each of the outlets to the respective valve means, each valve means being operable to direct water fed thereto from the associated outlet alternatively to one of the respective water using boilers and a relief means.

2. A method of operating a fluid system comprising a plurality of water using boilers, a single pump means, and a flow control device, the flow control device comprising a chamber, an inlet to the chamber, means connecting the inlet to the single pump means which supplies a head of water to the flow control device, and the flow control device further comprising a plurality of outlets, one for each of the water using boilers, a valve means associated with each outlet, means connecting each of the outlets to the respective valve means, each valve means being operable to direct water fed thereto from the associated outlet alternatively to one of the respective water using boilers and a relief means, the method comprising the step of sensing a parameter of the system to which each of the boilers contribute, signaling a control means when an upper threshold value of the parameter is sensed, the control means in response deactivating at least one of the boilers and signaling the associated valve means to direct fluid from the respective outlet of the flow control device to the relief means, the sensor means signaling the control means when a lower threshold value of the parameter is sensed, the control means in response reactivating at least one of the boilers which are inactive, and signaling the respective valve means to direct water to the reactivated boiler.

3. A system according to claim 1 wherein the pump is able to deliver more fluid to the flow control device than required by any one fluid using means.

4. A system according to claim 1 wherein each of the outlets of the flow control device is sized to ensure that the amount of fluid fed to the respective water using boiler, when the associated valve means permits this, is that required by the respective boiler.

5. A system according to claim 4 wherein each outlet from the chamber is sized so that the pressure in the chamber is always greater than the pressure downstream of the flow control device.

6. A system according to claim 1 wherein each of the valve means is controlled by a control means responsible to a sensor means which senses a parameter of the system to which all of the boilers contribute so that when a threshold value of the parameter is sensed, at least one of the boilers is deactivated, and the associated valve means is operated to cause water from the respective outlet of the chamber to be directed to the relief means.

7. A system according to claim 1 wherein all of the outlets from the chamber of the flow control device are of the same size and the boilers are all similarly rated.

8. A system according to claim 1 wherein the relief means comprises a conduit which returns water from each valve means to a reservoir from where water is drawn to supply the head of fluid.

9. A system according to claim 1 which comprises a steam raising system each of the fluid using means comprising a flash boiler.

10. A system according to claim 9 wherein each of the valve means is controlled by a control means responsive to a sensor means which senses the pressure of steam produced by the flash boilers so that when a threshold pressure is sensed, at least one of the boilers is deactivated and the associated valve means is operated to cause water from the respective outlet of the chamber to be directed to the relief means.

11. A system according to claim 9 wherein the system incorporates a steam accumulator to which steam is fed from the or each flash boiler and the pressure of steam in the accumulator is sensed by the sensor means.

12. A system according to claim 10 wherein the control means is arranged to deactivate and reactivate the flash boilers and operate the respective valve means in a predetermined sequence to ensure that each of the flash boilers are used generally equally.

* * * * *